US005251891A

United States Patent [19]

Blaser et al.

[11] Patent Number: 5,251,891

[45] Date of Patent: Oct. 12, 1993

[54] ASSEMBLY AND METHOD FOR CONTROLLING INDIVIDUAL POSITIONING ELEMENTS IN A DELIVERY REGION OF A PRINTING MACHINE

[75] Inventors: Peter T. Blaser, Dielheim; Dieter Hauck, Eberbach; Karl-Hermann Miltner, Dossenheim; Anton Rodi, Leimen, all of Fed. Rep. of Germany

[73] Assignee: Heidelberger Druckmaschinen AG, Heidelberg, Fed. Rep. of Germany

[21] Appl. No.: 930,174

[22] Filed: Aug. 17, 1992

[30] Foreign Application Priority Data

Aug. 16, 1991 [DE] Fed. Rep. of Germany ..... 4127095
Jun. 24, 1992 [DE] Fed. Rep. of Germany ..... 4220582

[51] Int. Cl.[5] ..... B65H 29/04

[52] U.S. Cl. ..... 271/176; 271/183; 271/204

[58] Field of Search ..... 271/183, 202, 204, 182, 271/176

[56] References Cited

U.S. PATENT DOCUMENTS 4,643,414 2/1987 Weisgerber ..... 271/183
4,717,141 1/1988 Germann ..... 271/183
4,776,577 10/1988 Marschke ..... 271/183 X

*Primary Examiner*—Richard A. Schacher
*Attorney, Agent, or Firm*—Herbert L. Lerner; Laurence A. Greenberg

[57] ABSTRACT

An assembly for controlling individual positioning elements in a delivery region of a sheet-fed printing machine, including at least one computer, at least one input device connected to the computer for inputting therein characteristic data specific to a sheet and/or to the printing machine, the computer having devices for further processing the characteristic data, and a control device operatively connected to the computer and having individual positioning elements for causing a format-dependent adjustment in accordance with the inputted characteristic data, the computer having devices for calculating, from the characteristic data, energy of the sheet oncoming to the delivery region and, in accordance with the calculated energy value, also for calculating an actuating value for at least one individual positioning element in the delivery region so that energy withdrawal by the individual positioning element is substantially equal to the energy of the oncoming sheet in the delivery region, the control device having devices for actuating the individual positioning element in accordance with the calculated value; and method of operation.

17 Claims, 2 Drawing Sheets

ASSEMBLY AND METHOD FOR CONTROLLING INDIVIDUAL POSITIONING ELEMENTS IN A DELIVERY REGION OF A PRINTING MACHINE

The invention relates to an assembly and method for controlling, i.e., by closed and/or open-loop control, individual positioning elements in a delivery region of a sheet-fed printing machine and, more particularly, wherein at least one input device is provided for inputting characteristic data specific to the sheet and/or to the printing machine, and at least one computer device is provided for further processing the characteristic data, and wherein a control device is also provided which, with individual positioning elements effects a format-dependent adjustment in accordance with the characteristic data indicated.

German Patent Document No. 34 13 179 A1 discloses an open and closed-loop control device for a sheet delivery of a sheetfed printing machine. Via at least one input device, data regarding the sheet format, the weight of the paper and the rotary speed of the machine are input into a computer. Format-dependent adjustments are made in accordance with the input data. Moreover, an adjustment of the gripper opening cam or of the suction roller, for example, is made in accordance with nominal or set-point values, which were established empirically for each operating state and stored in a memory element in the form of families of characteristic curves.

A disadvantage of this heretoforeknown control device is that empirical or trial and error determinations of the various setting data as a function of the paper weight and rotary speed variables are very tedious and time-consuming. Moreover, the ascertainment of these families of characteristic curves must be accomplished by a qualified technician. Storing the families of characteristic data in memory also requires a large memory capacity.

Problems may also occur because there are no continuous characteristic curves in the families of characteristic curves. Instead, the measurements are performed for several fixed combinations of parameters; then, the measured values are interpolated. Moreover, there is provided in the German Patent Publication No. 34 13 179 A1 corresponding to U.S. Pat. No. 4,643,414 a capability of correcting individual setting values in order to optimize the sheet delivery by the printer, but such corrections cause discontinuities in the characteristic curves.

Departing from the foregoing prior art, it is an object of the invention to provide a device and method for open and/or closed-loop control of positioning elements in a sheet delivery region of a sheet-fed printing machine which determines setting or adjustment values for the positioning elements of the sheet delivery through the application of characteristic data specific to the paper and the printing machine.

With the foregoing and other objects in view, there is provided, in accordance with the invention, an assembly for controlling individual positioning elements in a delivery region of a sheet-fed printing machine, comprising at least one computer, at least one input device connected to the computer for inputting therein characteristic data specific to a sheet and/or to the printing machine, the computer having means for further processing the characteristic data, and a control device operatively connected to the computer and having individual positioning elements for causing a format-dependent adjustment in accordance with the inputted characteristic data, the computer having means for calculating, from the characteristic data, energy of the sheet oncoming to the delivery region and, in accordance with the calculated energy value, also for calculating an actuating value for at least one individual positioning element in the delivery region so that energy withdrawal by the individual positioning element is substantially equal to the energy of the oncoming sheet in the delivery region, the control device having means for actuating the individual positioning element in accordance with the calculated value.

In accordance with another feature of the invention, the one individual positioning element is selected from the group consisting of a suction roller, a gripper opening cam and blower nozzles located above a delivery pile.

In accordance with a further feature of the invention, the one individual positioning element is the suction roller, and individual positioning elements other than the one individual positioning element are, respectively, the gripper opening cam and the blower nozzles.

In accordance with an additional feature of the invention, the one individual positioning element is the suction roller, and the actuating value to be calculated by the computer means is a suction force of the suction roller, derivable in accordance with the following equation:

$$F = \frac{m * v^2}{2 * \mu * s},$$

where m represents mass of the oncoming sheet, v velocity of the oncoming sheet in the delivery region, $\mu$ a coefficient of friction, and s a sheet length over which the suction force (F) of the suction roller acts.

In accordance with an added feature of the invention, there are provided a plurality of input devices for feeding to the computer information regarding increase in mass due to applications of ink, varnish, dampening medium, and/or powder onto the sheet, the increase in mass being taken into account by the computer in calculating the energy of the oncoming sheet in the delivery region.

In accordance with another aspect of the invention, there is provided a method of controlling individual positioning elements in a sheet delivery region of a sheet-fed printing machine, which comprises a first step of inputting characteristic data specific to a sheet and/or to the printing machine into a computer, a second step of further processing the characteristic data in the computer, and a third step of making a format-dependent adjustment in accordance with the inputted characteristic data with at least one individual positioning element of a control device, and wherein the second step includes calculating energy of the sheet oncoming to the delivery region from the characteristic data and, in accordance with the calculated energy value, also calculating an actuating value for the individual positioning element in the sheet delivery region so that energy withdrawal by the individual printing element is substantially equal to the energy of the sheet oncoming to the delivery region, and wherein the third step includes actuating the individual positioning element in accordance with the calculated actuating value.

In accordance with further details of the method invention, the one individual positioning element is a suction roller, and the calculated actuation value is a suction force of the suction roller, derivable in accordance with the following equation:

$$F = \frac{m * v^2}{2 * \mu * s},$$

where m represents mass of the sheet, v velocity of the sheet oncoming to the delivery region, $\mu$ a coefficient of friction, and s a sheet length over which the suction force (F) of the suction roller acts. Thus, for a constant sheet length s over which the suction force of the suction roller acts, or in other words with a fixed setting of the gripper opening cam, the suction force F of the suction roller varies as a function of the square of the velocity of the sheet arriving in the sheet delivery.

In accordance with an added mode of the invention, the method includes, when a maximum suction force $F_{max}$ of the suction roller is reached, calculating with the computer the sheet length s over which the suction force of the suction roller acts, in accordance with the following equation:

$$S = \frac{m * v^2}{2 * \mu * F_{max}}.$$

In accordance with an alternative mode of the method invention, wherein another one of the individual positioning elements is a gripper opening cam, the method includes calculating in the computer, as a function of the energy with which the sheet comes on to the delivery region, the sheet length s over which the suction force F of the suction roller acts, in accordance with the following equation:

$$S = \frac{m * v^2}{2 * \mu * F},$$

and wherein the third step includes actuating the gripper opening cam in accordance with the calculated values.

Once the maximum possible sheet length is attained, in accordance with an additional mode of the invention, the method includes, when a maximum possible sheet length $S_{max}$ is reached, calculating with the computer the suction force F of the suction roller, in accordance with the following equation:

$$F = \frac{m * v^2}{2 * \mu * S_{max}},$$

and wherein the third step includes actuating the suction roller in accordance with the calculated values.

Typically, the procedure calls for calculating the suction force in accordance with the foregoing equation, namely:

$$F = \frac{m * v^2}{2 * \mu * s}.$$

Initially, s is kept constant. In adjusting or setting the sheet length s, there is taken into account that the sheet arrives better for the deposit thereof, the longer it is guided by the grippers or, in other words, the shorter the sheet length s is. Only in exceptional cases is a correction of the sheet delivery therefore performed by varying the sheet length s over which the suction force of the suction roller acts.

In accordance with yet another mode of the invention, the method includes feeding information to the computer from a plurality of the individual positioning elements, regarding an increase in mass due to applications of ink, varnish, dampening medium and/or powder onto the sheet, and taking the increase in mass into account in calculating the energy of the sheet oncoming to the delivery region. For example, information can be optimized regarding the quantity of ink applied to the sheet from the position of the ink slides. The amount of varnish, dampening medium and/or powder on the sheet can also be determined without difficulty.

In accordance with an alternative or additional mode of the invention, the method includes inputting a correction factor k via the input device to the computer for influencing one of the parameters consisting of the suction force F of the suction roller and the sheet length s. Thus, alternatively, or in addition, an input device is provided, via which the pressman influences the suction force of the suction roller or the sheet length over which the suction force of the suction roller acts, by means of a correction factor k. For instance, if an increase in mass due to the thickness of ink, varnish, dampener or powder is not taken into account in the original computer program, then this provision affords the pressman an opportunity by having an effect upon the depositing of the sheet by introducing a correction of the suction force of the suction roller or of the gripper opening cam.

In accordance with yet a further mode of the invention, the method includes, when, respectively, control limiting maximum suction force $F_{max}$ is reached and a maximum sheet length $S_{max}$ is attained, taking the correction factor k into account for calculating the sheet length s over which the suction force F of the suction roller acts, and for calculating the suction force F, respectively. Thus, a correction factor k inputted by the pressman is taken into account in calculating the suction force F of the suction roller or in calculating the sheet length s and, when the control limit of the suction force $F_{max}$ or the maximum sheet length $s_{max}$ is attained, the indicated correction factor is adopted for calculating the sheet length s or for calculating the suction force F. The use of a correction factor has the advantage that corrections become effective over the entire speed range, so that no discontinuities in the set values for the positioning elements occur.

In accordance with yet an added mode of the invention, the method includes, after completion of a printing job, storing the correction factor k in a memory of the computer. The values stored in memory are then automatically adopted as a specified or default value for a subsequent printing job with the same parameters, so that a new correction of the settings of the suction roller and of the gripper opening cam, respectively, is unnecessary, or only slightly necessary.

In accordance with another mode of the invention, the method includes controlling with the control device a supply source for the powder so that the quantity of powder per unit of surface area which is applied is constant, in accordance with the machine speed.

In accordance with a further mode of the invention, the method includes, with the computer, calculating the quantity of powder as a function of a final height of a sheet pile in the sheet delivery region. Thus, the quantity of powder applied to the sheet, for example, can decrease linearly from a lower edge of the sheet pile to an upper edge of the sheet pile. Because the pressure on the lower sheets is considerably higher than on the upper sheets, adhesion of the sheets in the lower portion of the sheet pile is thereby avoided.

In accordance with a concomitant mode of the invention, the method includes feeding data via an input device to a control device regarding mass distribution of a printed sheet coming on to the sheet delivery region and, with the control device, actuating blower nozzles located above a sheet pile in the delivery region so that a pressure distribution is produced over the surface of the sheet which correlates with the mass distribution of the sheet.

Because the blower nozzles are actuated by the control device so that the distribution of pressure is equivalent to the actual distribution of mass per unit of surface area of the sheet, the sheet can be delivered to the sheet pile exactly and quickly. Under some circumstances it may be advantageous to adjust or set the blower nozzles so that the middle of the sheet will deposit first due to the pressure distribution. The deposit may also be performed, however, so that, starting from the location deposited first, which is generally eccentric, the air rapidly escapes outwardly from beneath the sheet. The blower nozzles acting on the sheet from the top may optionally then be reinforced with suction devices disposed laterally to the stack.

The distribution of mass per unit of surface area can be determined exactly with the aid of the computer if the computer is supplied with data as to the paper thickness and the thickness of ink, powder, and/or varnish applied thereto. For example, the information regarding ink distribution can be determined by the setting or adjustment of the inking zone screws. It is also advantageous if, for determining the mass distribution, the surface of the sheet is broken down into matrix-like surface-area elements and, for these surface-area elements, not only the paper weight but also the mass of the ink, varnish, dampening medium and powder, less evaporation and powder loss, respectively, are ascertained. Auxiliary devices which may be installed include devices for measuring the weight of the sheet pile before printing and after printing. Setting a pressure distribution which matches the same distribution by means of the blower nozzles can be effected in various ways, depending upon the particular construction of the embodiment. For example, it is possible to vary the quantity of blowing air, the number of blower nozzles which are turned on, as well as the direction of the blowing effect as a function of conventional sheet-specific and machine-specific data.

It is advantageous, from a construction standpoint, if a blowing air device, i.e., an air blower is provided above the sheet pile and has air outlet nozzles distributed in matrixlike fashion over the surface of the sheet, the nozzles being individually supplied with blowing air by means of the control device. It is thereby possible to have blowing air discharge from those nozzles which act upon a region of the sheet which is to be deposited first, before having the blowing air discharge from the other nozzles. For example, the nozzles are shut off in rows, beginning at the trailing or rear edge and proceeding toward the leading or front edge.

Other features which are considered as characteristic for the invention are set forth in the appended claims.

Although the invention is illustrated and described herein as embodied in an assembly and method for controlling individual positioning elements in a delivery region of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
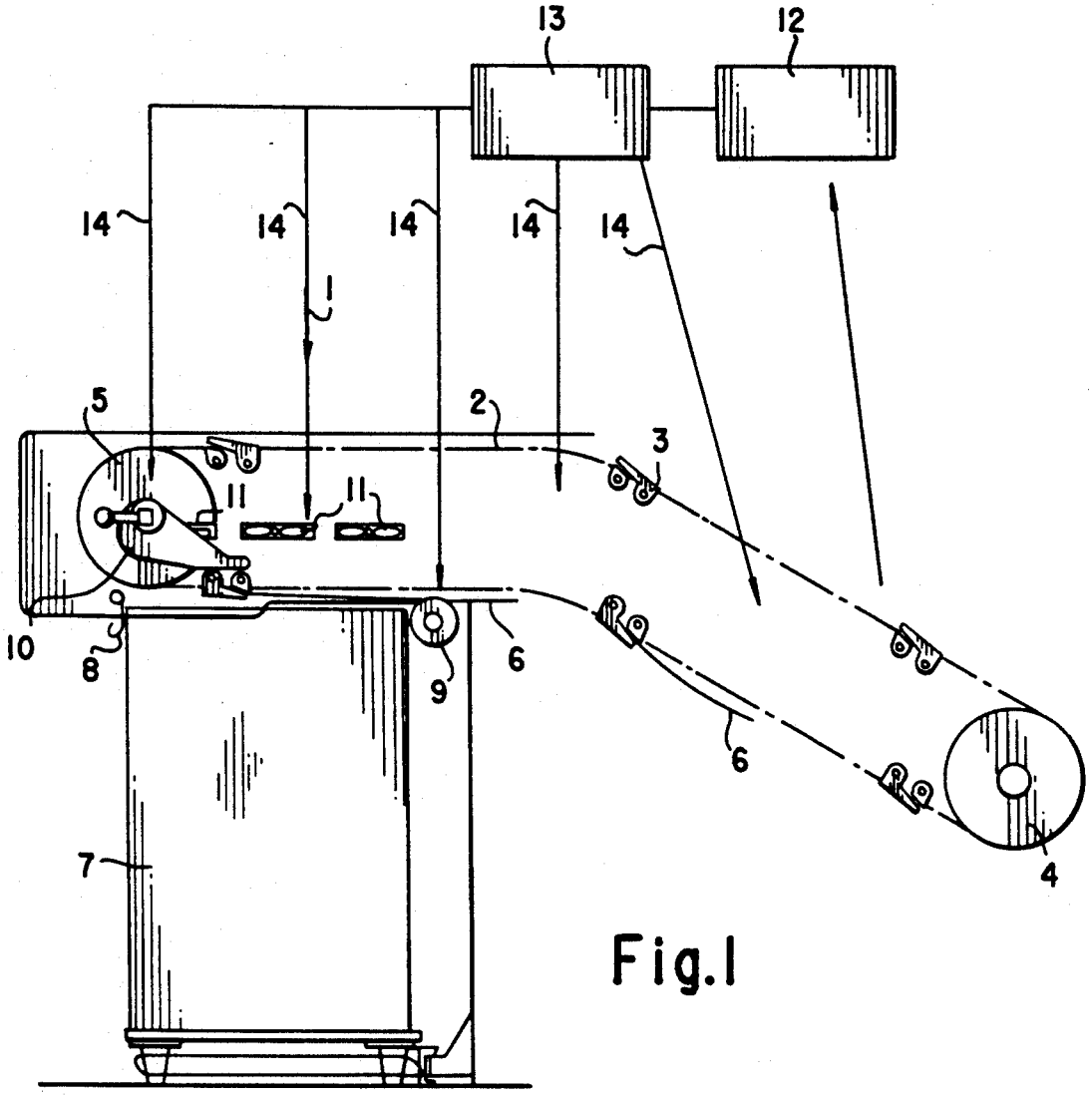
FIG. 1 is a diagrammatic side elevational view of the delivery region of a sheet-fed rotary printing machine.

Referring now to the drawing and, first, particularly to FIG. 1 thereof, there is shown therein a diagrammatic side elevational view of a sheet delivery 1 of an otherwise non-illustrated sheet-fed rotary printing machine. Chains 2 carrying gripper bridges 3 run over guide wheels 4 and 5. The gripper bridges 3 feed sheets 6 in a direction towards a delivery pile 7. The sheets 6 are braked by a suction roller 9, the instant the sheets 6 are released by the gripper bridges 3 above the delivery pile 7. The gripper bridges 3 are controlled by a gripper opening cam 10. The sheet 6 is held down on the delivery pile 7 by means of blower nozzles 11.

The sheet 6 is deposited on the sheet pile 7 ideally when the braking distances are of such values that when the trailing edge of the sheets in the sheet pile 7 is reached, the kinetic energy of the oncoming sheet 6 is extremely low or even non-existent. This prevents the oncoming sheet 6 from striking sheet pile stops 8 so hard that damage might be caused to the sheet 6.

According to the invention, the setting of the suction roller 9 and/or the gripper opening cam 10 is controlled so that this condition is always met.

Figure 2:
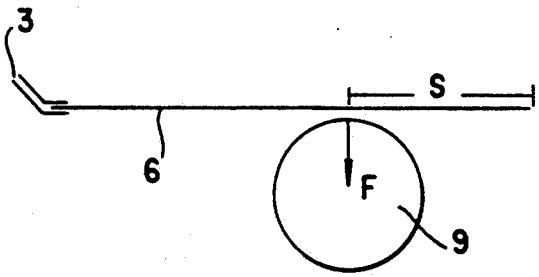
FIG. 2 is a fragmentary view of FIG. 1 schematically showing variables which can be calculated by the method of the invention.

The variables which serve to calculate the setting of the suction roller 9 or of the gripper opening cam 10 are shown schematically in FIG. 2.

FIG. 2 shows the region around the suction roller 9 of FIG. 1. The sheet 6 is guided by the gripper bridge 3 over the suction roller 9. The suction roller 9 is connected to a non-illustrated source of negative pressure. The suction roller 9 has an adjustable suction force F. As long as the sheet 6 is being guided by the gripper bridges 3, it moves at machine speed. If the gripper bridge 3 releases the sheet 6, then a braking of the sheet 6 occurs because of the suction force F of the suction roller 9. The suction force F of the suction roller 9 acts over a length s of the paper sheet 6. Taking into account the coefficient of friction $\mu$, the energy which is brought to bear by the suction roller 9 for braking the sheet 6 and thus for removing the energy E from the sheet 6 can be calculated by the equation:

$$E = F * \mu * s$$

In the ideal case, this withdrawal of energy from the sheet is equal to the kinetic energy, i.e., $\frac{1}{2} * m * v^2$, where m is the mass and v is the velocity, of the sheet 6 arriving in the delivery region of a sheet-fed rotary printing machine.

As noted hereinbefore, the suction force F of the suction roller 9 acts over the length of the paper sheet 6, after the sheet 6 is no longer being guided by the gripper bridges 3. It should be noted that it is possible that the suction roller 9 itself may also rotate. Only when the suction roller 9 is stationary, however, does s represent the length of the paper sheet 6 downstream from the suction roller 9. If the suction roller 9 rotates in the direction of paper travel or opposite to the direction of paper travel, the circumferential travel of the suction roller 9 from the instant of the opening of the gripper bridges 3 to the instant at which the sheet 6 has moved past the suction roller 9 must also be taken into account. The length s of the paper sheet 6 downstream from the suction roller 9 must be decreased by this circumferential travel distance when the rotation is in the paper travel direction and increased by that amount when the rotation is opposite to the paper travel direction.

It may generally be said that the sheet 6 is deposited better, the longer it is guided by the gripper bridges 3 or, in other words, the shorter the sheet length s is over which the suction force F of the suction roller 9 acts. The most favorable procedure for calculating the settings of the positioning elements in the delivery region will therefore be that wherein the adjustment of the gripper opening cam 10 is initially constant. The suction force F of the suction roller 9 can then be calculated in accordance with the following equation:

$$F = \frac{m * v^2}{2 * \mu * s},$$

i.e., as a function of the square of the velocity v of the sheet 6 arriving in the delivery region of the printing machine. The data necessary for the calculation, such as the mass of the sheet, and its length, width, thickness and density, respectively, as well as the velocity information are fed to a computer 13 via an input device 12. This input is effected either by the operator of the machine or pressman or by suitable measuring stations on the printing machine itself. For example, the paper thickness can be determined by way of the pressure in-feed adjustment and the cover or top mark height adjustment. Format-dependent information can be obtained from the pull lay position or by means of the ink zone setting. The velocity of the oncoming sheet 6 in the delivery region is readily determinable from the rotational speed of the printing machine. Information regarding the ink thickness in the various printing units, which might need to be taken into account for correcting the mass m of the sheet 6, can be determined from the position of the ink zone screws. In a similar way, the computer can also be provided with data as to the quantity of varnish, dampening machine, or powder applied to the sheet 6.

If the positioning force F of the suction roller 9 is determined in accordance with the equation:

$$F = \frac{m * v^2}{2 * \mu * s},$$

wherein s is constant, the computer thus calculates the necessary correction in setting the gripper opening cam 10 by way of the equation:

$$F = \frac{m * v^2}{2 * \mu * F_{max}},$$

If, for any reason, the calculated suction force F of the suction roller 9, for example, does not lead to an optimal delivery of the sheet 6 while the gripper opening cam 10 is at a fixed setting, the operator has the capability of varying the suction force F of the suction roller 9 by a correction factor k through the intermediary of the input device 12. If the control limit of the suction force $F_{max}$ of the suction roller 9 is reached when accelerating to the velocity v, the computer 13 takes this correction factor k into account, as well, in calculating the sheet length s. Naturally, s can also be influenced directly by the correction factor k. A favorable aspect of this procedure is that the correction is effective over the entire range of velocity and hence does not lead to any discontinuities in the adjustment or setting of the suction force F and the sheet length s, respectively, over which the suction force F acts.

Provision is further made for the correction factors to be taken over into a memory device as a function of the inputted parameters. These corrections are automatically taken into account in subsequent printing jobs with the same parameters for setting or adjusting the suction force F of the suction roller and for setting or adjusting the gripper opening cam 10, respectively.

Figure 3:
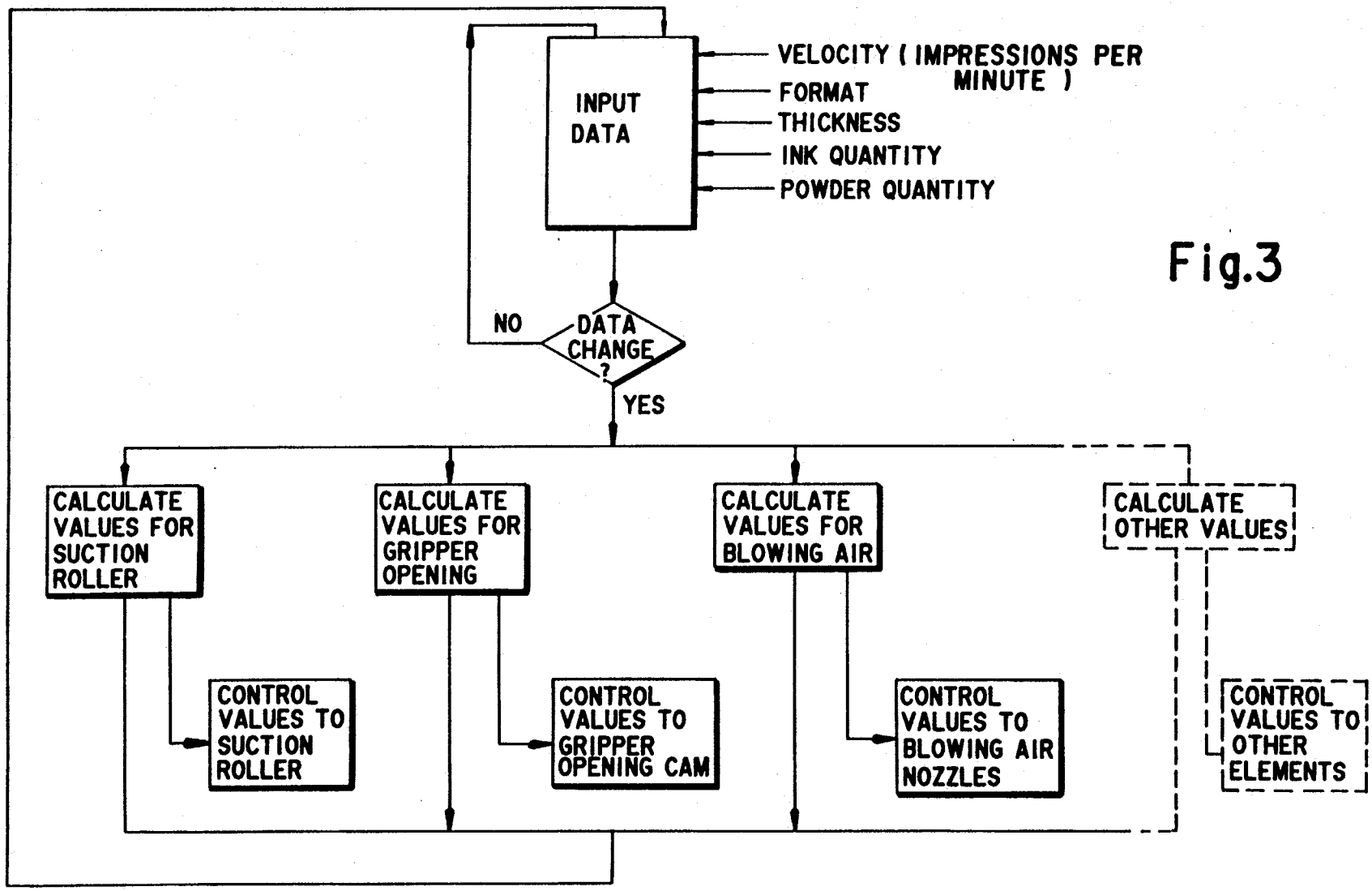
FIG. 3 is a flow chart of the inventive method.

In the flow chart of the method according to the invention shown in FIG. 3, input data such as impressions per minute, format, thickness, ink quantity and powder quantity, all with respect to the sheet oncoming to the sheet delivery region, are fed into the computer 13. When a change in the data occurs, the information regarding the change is fed back to the input of the computer 13. If no changes occur, the data are processed in the computer 13, and values for the suction roller 9, i.e., suction force F, for the gripper opening, i.e., for the gripper opening cam 10, and blowing air, i.e., for the blower nozzle 11, respectively, are calculated. Control values are then determined and adjustments of the suction roller 9, the gripper opening cam 10, and the blower nozzles 11, respectively, are made in accordance with the control values.

We claim:

1. An assembly for controlling individual positioning elements in a delivery region of a sheet-fed printing machine, comprising at least one computer, at least one input device connected to said computer for inputting therein characteristic data specific to a sheet and/or to the printing machine, said computer having means for further processing said characteristic data, and a control device operatively connected to said computer and having individual positioning elements for causing a format-dependent adjustment in accordance with said inputted characteristic data, said computer having means for calculating, from said characteristic data, kinetic energy of the sheet oncoming to the delivery region and for calculating a frictional force for at least one individual positioning element in the delivery region so that frictional energy withdrawal by the individual positioning element is substantially equal to the kinetic energy of the oncoming sheet in the delivery region, said control device having means for actuating said individual positioning element in accordance with the calculated frictional force.

2. Assembly according to claim 1, wherein said one individual position element is selected from the group consisting of a suction roller, a gripper opening cam and blower nozzles located above a delivery pile.

3. Assembly according to claim 2, wherein said one individual positioning element is said suction roller and individual positioning elements other than said one individual positioning element are, respectively, said gripper opening cam and said blower nozzles.

4. Assembly according to claim 2, wherein said one individual positioning element is said suction roller, and said frictional force to be calculated by said computer means is a suction force of the suction roller, derivable in accordance with the following equation being programmed into the computer:

$$F = \frac{m * v^2}{2 * \mu * s},$$

wherein m represents mass of the oncoming sheet, v velocity of the oncoming sheet in the delivery region, $\mu$ a coefficient of friction between said sheet and said positioning element, and s a sheet length over which the suction force (F) of the suction roller acts.

5. Assembly according to claim 2, including a plurality of input devices for feeding to the computer information regarding increase in mass due to applications of ink, varnish, dampening medium, and/or powder onto the sheet, said increase in mass being taken into account by the computer in calculating the energy of the oncoming sheet in the delivery region.

6. Method of controlling individual positioning elements in a sheet delivery region of a sheet-fed printing machine, which comprises a first step of inputting characteristic data specific to a sheet and/or to the printing machine into a computer, a second step of further processing the characteristic data in the computer, and a third step of making a format-dependent adjustment in accordance with the inputted characteristic data with at least one individual positioning element of a control device, and wherein the second step includes calculating kinetic energy of the sheet oncoming to the delivery region from the characteristic data and, in accordance with the calculated energy value, also calculating a frictional force for the individual positioning element in the sheet delivery region so that frictional energy withdrawal by the individual printing element is substantially equal to the kinetic energy of the sheet oncoming to the delivery region, and wherein the third step includes actuating the individual positioning element in accordance with the frictional force.

7. Method according to claim 6, wherein the one individual positioning element is a suction roller, and the calculated frictional force is a suction force of the suction roller, derivable in accordance with the following equation being programmed into the computer:

$$F = \frac{m * v^2}{2 * \mu * s},$$

where m represents mass of the sheet, v velocity of the sheet oncoming to the delivery region, $\mu$ a coefficient of friction between said sheet and said suction roller, and s a sheet length over which the suction force (F) of the suction roller acts.

8. Method according to claim 6, which comprises feeding information to the computer from a plurality of the individual positioning elements, regarding an increase in mass due to applications of ink, varnish, dampening medium and/or powder onto the sheet, and taking the increase in mass into account in calculating the kinetic energy of the sheet oncoming to the delivery region.

9. Method according to claim 7, which includes, when a maximum suction force $F_{max}$ of the suction roller is reached, calculating with the computer the sheet length s over which the suction force of the suction roller acts, in accordance with the following equation being programmed into the computer:

$$S = \frac{m * v^2}{2 * \mu * F_{max}}.$$

10. Method according to claim 7, wherein another one of the individual positioning elements is a gripper opening cam, and which includes calculating in the computer, as a function of the kinetic energy with which the sheet comes on to the delivery region, the sheet length s over which the suction force F of the suction roller acts, in accordance with the following equation being programmed into the computer:

$$S = \frac{m * v^2}{2 * \mu * F},$$

and wherein the third step includes actuating the gripper opening cam in accordance with the calculated values.

11. Method according to claim 7, which includes, when a maximum possible sheet length $S_{max}$ is reached, calculating with the computer the suction force F of the suction roller, in accordance with the following equation being programmed into the computer:

$$F = \frac{m * v^2}{2 * \mu * S_{max}},$$

and wherein the third step includes actuating the suction roller in accordance with the calculated values.

12. Method according to claim 7, which includes inputting a correction factor k via the input device to the computer for influencing one of the parameters consisting of the suction force F of the suction roller and the sheet length s.

13. Method according to claim 12, which includes, when, respectively, a limiting maximum suction force $F_{max}$ is reached and a maximum sheet length $S_{max}$ is attained, taking the correction factor k into account for calculating the sheet length s over which the suction force F of the suction roller acts, and for calculating the suction force F, respectively.

14. Method according to claim 12, which includes, after completion of a printing job, storing the correction factor k in a memory of the computer.

15. Method according to claim 8, which includes controlling with the control device a supply source for the powder so that the quantity of powder per unit of surface area which is applied is constant, in accordance with the machine speed.

16. Method according to claim 15, which includes, with the computer, calculating the quantity of powder as a function of a final height of a sheet pile in the sheet delivery region.

17. Method according to claim 8, which includes feeding data via an input device to a control device regarding mass distribution of a printed sheet coming on to the sheet delivery region and, with the control device, actuating blower nozzles located above a sheet pile in the delivery region so that a pressure distribution is produced over the surface of the sheet which correlates with the mass distribution of the sheet.

* * * * *